US011428460B2

(12) United States Patent
Yu et al.

(10) Patent No.: US 11,428,460 B2
(45) Date of Patent: Aug. 30, 2022

(54) REFRIGERATOR

(71) Applicant: LG ELECTRONICS INC., Seoul (KR)

(72) Inventors: Seonil Yu, Seoul (KR); Daesung Lee, Seoul (KR); Kyutae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/419,465

(22) PCT Filed: Dec. 9, 2019

(86) PCT No.: PCT/KR2019/017284
§ 371 (c)(1),
(2) Date: Jun. 29, 2021

(87) PCT Pub. No.: WO2020/145519
PCT Pub. Date: Jul. 16, 2020

(65) Prior Publication Data

US 2022/0074647 A1 Mar. 10, 2022

(30) Foreign Application Priority Data

Jan. 10, 2019 (KR) ..... 10-2019-0003203

(51) Int. Cl.
*F25D 25/02* (2006.01)
*F25D 27/00* (2006.01)
(Continued)

(52) U.S. Cl.
CPC ..... *F25D 25/024* (2013.01); *F25D 27/005* (2013.01); *F25D 29/005* (2013.01);
(Continued)

(58) Field of Classification Search
CPC ..... F25D 23/028; F25D 25/02; F25D 25/024; F25D 27/00; F25D 27/005; F25D 31/007;
(Continued)

(56) References Cited

U.S. PATENT DOCUMENTS 2,568,153 A * 9/1951 Hickman ..... F24C 15/16 211/153
3,224,081 A * 12/1965 Richter ..... F25D 25/02 29/897.15
(Continued)

FOREIGN PATENT DOCUMENTS

DE 102012223595 A1 * 6/2014 ..... F25D 25/02
DE 102017003383 A1 * 5/2018 ..... F25D 27/00
(Continued)

*Primary Examiner* — Andrew M Roersma
(74) *Attorney, Agent, or Firm* — Dentons US LLP

(57) ABSTRACT

The present disclosure is relates to a refrigerator. The refrigerator includes first storage for defining a first storage space therein, a door for opening and closing the first storage space, and a plurality of shelves installed in the first storage space for placing an object thereon. The shelf includes a frame having a plurality of support bars for loading a plurality of wine bottles thereon, a shelf bracket detachably mounted and fixed in the storage space, and an extending rail for supporting the frame to be able to be extended forwardly of the first storage from the shelf bracket.

12 Claims, 8 Drawing Sheets

(51) Int. Cl.
*F25D 29/00* (2006.01)
*F25D 31/00* (2006.01)

(52) U.S. Cl.
CPC ..... *F25D 31/007* (2013.01); *F25D 2331/803* (2013.01); *F25D 2400/36* (2013.01); *F25D 2700/02* (2013.01)

(58) Field of Classification Search
CPC ..... F25D 2327/00; F25D 2331/803; F25D 2400/36
See application file for complete search history.

(56) References Cited

U.S. PATENT DOCUMENTS 4,341,314 A * 7/1982 Feuerstein ..... A47B 57/581 211/184
6,454,108 B1 * 9/2002 Gerard ..... A47B 73/00 211/74
6,786,562 B2 9/2004 Obrock et al.
6,951,402 B1 * 10/2005 Copp ..... F25D 27/005 362/94
7,673,761 B2 3/2010 Lee et al.
9,989,298 B1 * 6/2018 Wantland ..... A47B 96/061
10,485,339 B2 * 11/2019 Hao ..... F25D 25/02
2014/0217879 A1 * 8/2014 Kerner ..... F25D 25/02 312/408
2017/0205138 A1 * 7/2017 Hwang ..... G06Q 10/087
2018/0080707 A1 * 3/2018 Alyanak ..... F25D 25/024

FOREIGN PATENT DOCUMENTS

JP 2001-201251 A 7/2001
KR 10-2011-0034271 A 4/2011
KR 1020110081370 A * 7/2011
KR 10-1510695 A 4/2015
WO WO-2019085964 A1 * 5/2019 ..... F25D 31/002

* cited by examiner

REFRIGERATOR

This application is the National Phase of PCT International Application No. PCT/KR2019/017284, filed on Dec. 9, 2019, which claims priority under 35 U.S.C. 119(a) to Korean Patent Application No. 10-2019-0003203, filed on Jan. 10, 2019, which is hereby incorporated by reference herein in their entirety.

TECHNICAL FIELD

The present disclosure relates to a refrigerator, and more particularly, to a refrigerator having a plurality of storage spaces defined therein.

BACKGROUND ART

In general, a refrigerator is an apparatus that uses a refrigeration cycle composed of a compressor, a condenser, an expansion valve, and an evaporator to maintain a temperature of a storage compartment disposed in the refrigerator at a predetermined temperature, thereby freezing or refrigerating and storing food or the like. The refrigerator generally includes a freezing compartment for freezing and storing the food or drink and a refrigerating compartment for storing the food or the drink at a low temperature.

The refrigerator may be distinguished by positions of the freezing compartment and the refrigerating compartment. For example, the refrigerator may be divided into a top mount type in which the freezing compartment is located above the refrigerating compartment, a bottom freezer type in which the freezing compartment is located below the refrigerating compartment, and a side by side type in which the freezing compartment and the refrigerating compartment are divided into left and right sides by a partition.

Recently, a refrigerator, which, in order to meet various needs of consumers, may freely adjust temperatures of the refrigerating compartment and the freezing compartment depending on food stored in the refrigerator, and may allow the freezing compartment to have the same temperature as the refrigerating compartment, so that the refrigerating compartment of a larger space may be used, has been proposed and used.

Storage days of the food varies depending on a type and processing and packaging conditions, and recently, a refrigerator has been used to properly store items such as cosmetics, wine, or the like.

It is known that the wine is in a state of ripening in a bottle, so that special care and effort should be paid to handling and storage of the wine. When handling and storing the wine, attention should be paid to temperature, sunlight, humidity, vibration, levelness, and the like. The sunlight, humidity, and levelness may be solved relatively simply, but much research and effort have been made to maintain proper temperature and to block vibration.

An environment in which the wine is stored is preferably a place where ventilation is good, a change in the temperature/humidity is small, and there is no vibration. As such an environment, there have been a underground warehouse, a cave, a basement floor, and the like. However, such a natural environment is very difficult to find, so that the refrigerator has been used to artificially create such an environment.

Further, in order to obtain optimum flavor by the refrigerator, it is important to implement a particularly suitable temperature environment, among the above-mentioned various conditions such as the temperature, humidity, ventilation, and the like. A suitable temperature for storing the wine is known to be about 12° C. to 18° C. for red wine and about 6° C. to 11° C. for white wine.

Therefore, in order to store the wine bottles requiring such various temperature conditions in one storage space, the refrigerator is configured such that an internal space thereof may be divided into a plurality of spaces, and the divided plurality of spaces may individually control the temperature.

In addition, a conventional refrigerator has a plurality of shelves for storing a plurality of wine bottles, and the plurality of shelves are spaced apart from each other by a predetermined spacing such that the wine may be stored.

In one example, in the conventional refrigerator, the spacing between two adjacent shelves on which the wine is stored is relatively narrow in order to store the plurality of wine bottles, so that it is inconvenient to withdraw the wine bottle.

In addition, the conventional refrigerator has a purpose only for the storage of the wine simply, so that there was an inconvenience of having to withdraw and identify the wine bottles stored on the shelf one by one in order to identify a type of the wine stored on the shelf.

DISCLOSURE

Technical Problem

The present disclosure is devised to solve the above problems, and one purpose of the present disclosure is to provide a refrigerator that allows a user to easily identify wine stored on a shelf by improving a structure of the shelf on which the wine is stored.

Further, the present disclosure is devised to solve the above problems, and another purpose of the present disclosure is to provide a refrigerator that allows wine stored on a shelf to be easily identified by removing shadow formed by the shelf on which the wine is stored.

Further, the present disclosure is devised to solve the above problems, and another purpose of the present disclosure is to provide a refrigerator that allows wine stored on a shelf to be easily identified by allowing the shelf on which the wine is stored to be extended.

Technical Solution

A refrigerator according to an embodiment of the present disclosure for achieving the above-mentioned purposes preferably includes first storage for defining a first storage space therein, a door for opening and closing the first storage space, and a plurality of shelves installed in the first storage space for placing an object thereon, wherein the shelf includes a frame having a plurality of support bars for loading a plurality of wine bottles thereon, a shelf bracket detachably mounted and fixed in the storage space, and an extending rail for supporting the frame to be able to be extended forwardly of the first storage from the shelf bracket.

Further, it is preferable that the frame includes a front frame defining a front face of the frame, wherein a front face of the support bar is fixed to the front frame, a rear frame defining a rear face of the frame, wherein a rear face of the support bar is fixed to the rear frame, and each side frame defining each of both side faces of the frame, wherein each side frame is fastened to each shelf bracket by each extending rail.

Further, it is preferable that the front frame has a front lamp module irradiating light to another wine shelf located below in a rearward direction, and the rear frame has a rear lamp module irradiating light to another wine shelf located below in a forward direction.

Further, it is preferable that the front lamp module and the rear lamp module are associated with opening and closing of the door, and operated when the door is opened.

Further, it is preferable that the support bar further includes downwardly inclined faces in contact with a circumferential face of the object loaded on the shelf, wherein the downwardly inclined faces are respectively formed on both sides of a top face of the support bar, wherein each downwardly inclined face extends in a longitudinal direction.

Further, it is preferable that the support bar is made of wood.

Further, it is preferable that the frame further includes a hook bar for preventing the object from deviating rearwardly of the support bar and rearwardly of the shelf.

Further, it is preferable that the frame, the extending rail, and the shelf bracket are detachable from a rear face of the first storage space in a state of being fastened with each other.

Further, it is preferable that second storage having a second storage space defined therein is disposed below the first storage, wherein the second storage space is operated independently of the first storage.

Further, it is preferable that the second storage includes at least one drawer extended from the second storage space to open the second storage space.

Further, it is preferable that the door further includes a manipulator for controlling the first storage and the second storage, and a display for displaying operating states of the first storage and the second storage.

Advantageous Effects

In the refrigerator according to the present disclosure, the structure of the shelf on which the wine is stored is improved, so that the user may easily identify the wine stored on the shelf.

Further, in the refrigerator according to the present disclosure, light is irradiated from a bottom face of the shelf to the wine located below the shelf, so that the wine stored on the shelf may easily identified.

Further, in the refrigerator according to the present disclosure, the shelf on which the wine is stored is able to be extended, so that the wine stored on the shelf may easily identified.

BEST MODE

Hereinafter, a refrigerator according to an embodiment of the present disclosure will be described in detail. In describing the present disclosure, the names of the components to be defined are defined in consideration of their functions in the present disclosure. Therefore, it should not be understood to limit the technical components of the present disclosure. In addition, each name defined to each component may be referred to as another name in the art.

First, a refrigerator according to an embodiment of the present disclosure will be described in detail with reference to the accompanying drawings.

Figure 1:
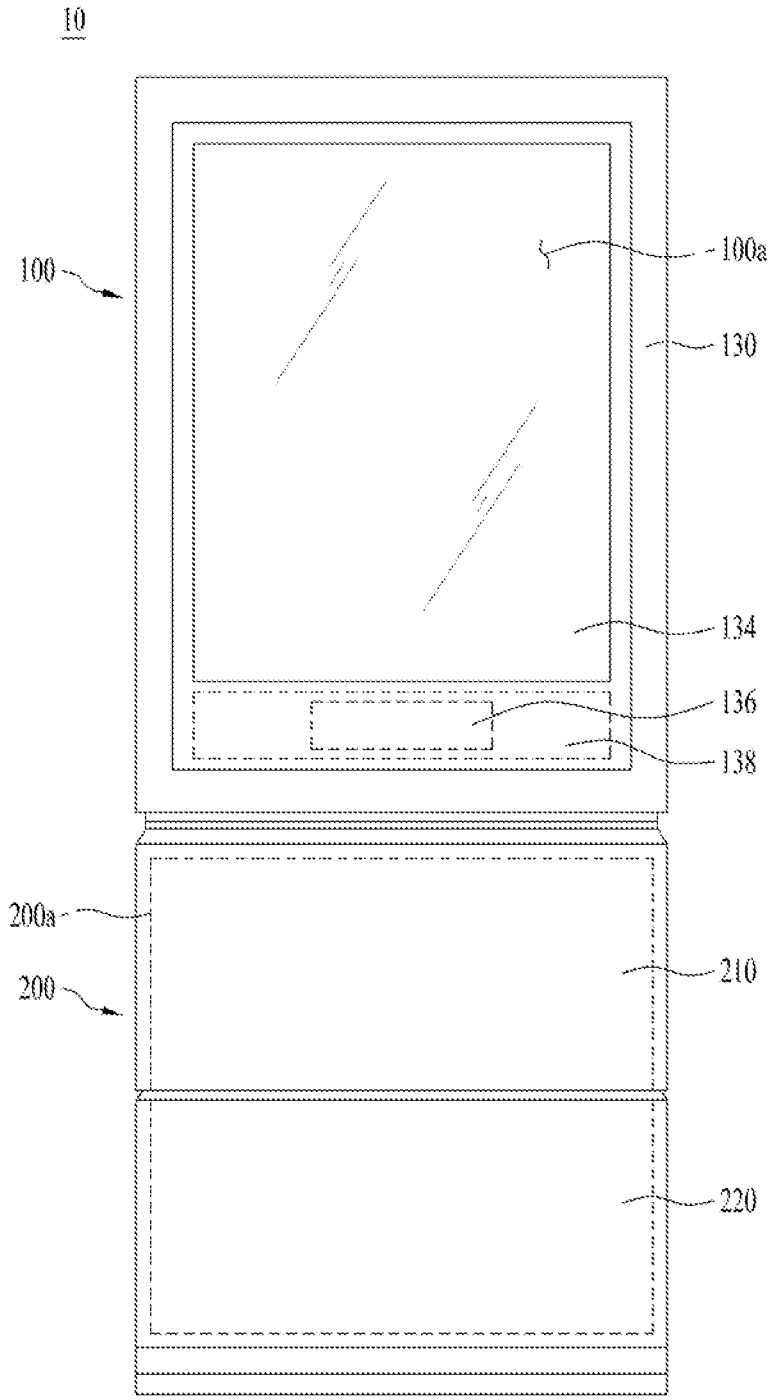
FIG. 1 is a front view illustrating a refrigerator according to the present disclosure.
Figure 2:
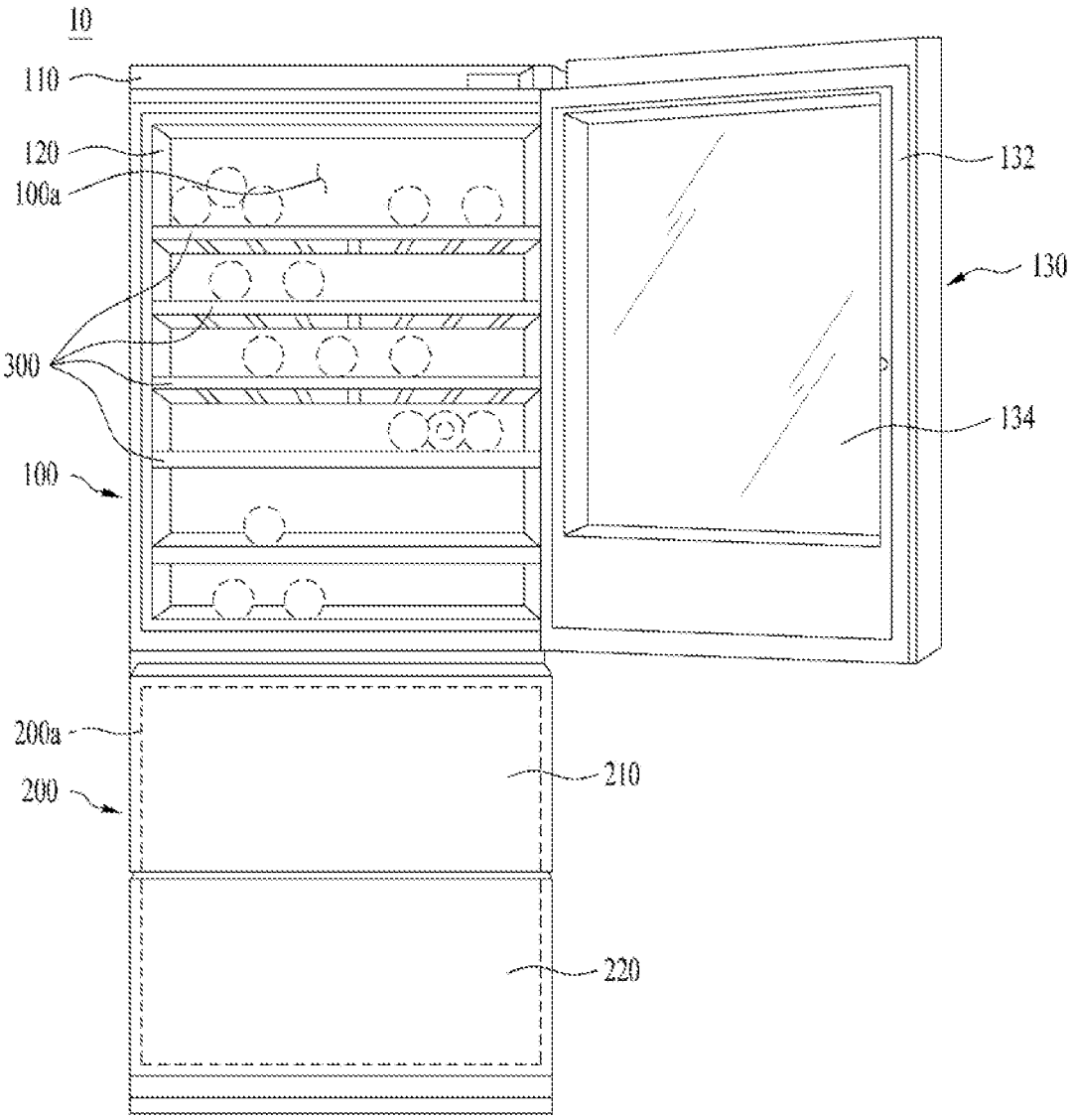
FIG. 2 is a front view illustrating a state in which a door of a refrigerator according to the present disclosure is open.

FIG. 1 is a front view illustrating a refrigerator according to the present disclosure, and FIG. 2 is a front view illustrating a state in which a door of a refrigerator according to the present disclosure is open.

As shown in FIGS. 1 to 2, a refrigerator 10 according to the present disclosure is formed in a substantially rectangular parallelepiped shape with an open front face. The refrigerator 10 includes first storage 100 positioned at an upper portion of the refrigerator 10 and having a first storage space 100*a* defined therein, and second storage 200 positioned below the first storage 100 and having a second storage space 200*a* defined therein, which is extended and retracted in a drawer form.

In this connection, the first storage space 100*a* or the second storage space 200*a*, which is a storage space for storing food, may be selectively provided as a refrigerating compartment or a freezing compartment. In the present embodiment, for convenience of description, the first storage space 100*a* and the second storage space 200*a* will be described as being used as the refrigerating compartment as an example, but the present disclosure is not limited thereto.

That is, depending on a type or a temperature of the food stored in the first storage space 100*a* or the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

Further, the first storage space 100*a* has a front opening, and a door 130 for opening and closing the first storage space 100*a* is pivotably disposed at one side of the opening.

In addition, the first storage space 100*a* may have a plurality of shelves for loading the food to be stored in the first storage space 100*a*. In the embodiment of the present disclosure, the present disclosure may have the plurality of shelves as wine shelves 300 for storing a plurality of wine bottles.

Further, the second storage 200 may be located below the first storage, and may have one or more drawers 210 and 220 in a form of being extended in a forward direction of the refrigerator. In the second storage, the second storage space where the food is stored may be exposed by the extension of the drawer, and the second storage space may be divided by the plurality of drawers.

Further, a machine room (not shown) for controlling temperatures of the first storage space 100*a* and the second storage space 200*a* may be defined in a separate space that is separated from the first storage space 100*a* and the second storage space 200*a* inside the refrigerator 10.

In this connection, the machine room may include a refrigerant cycle composed of a compressor, a condenser, an expander, an evaporator, and a flow path for supplying cold air to the first storage space 100*a* and the second storage space 200*a*. Various embodiments may be available for such a location and configuration of the machine room, so that a detailed description thereof will be omitted.

The second storage 200 may be located below the first storage 100, and may be used as the refrigerating compartment or the freezing compartment independently of the first storage 100. Such second storage 200 may include one or more drawers 210 and 220, each of which opens the second storage space 200*a* of the second storage 200, and defines a space for loading the food therein, at the same time. The drawers 210 and 220 may include an upper drawer 210 forming an upper front face of the second storage 200 and a lower drawer 220 forming a lower front face of the second storage 200.

Hereinafter, the first storage 100 will be described in detail with reference to the accompanying drawings.

Figure 3:
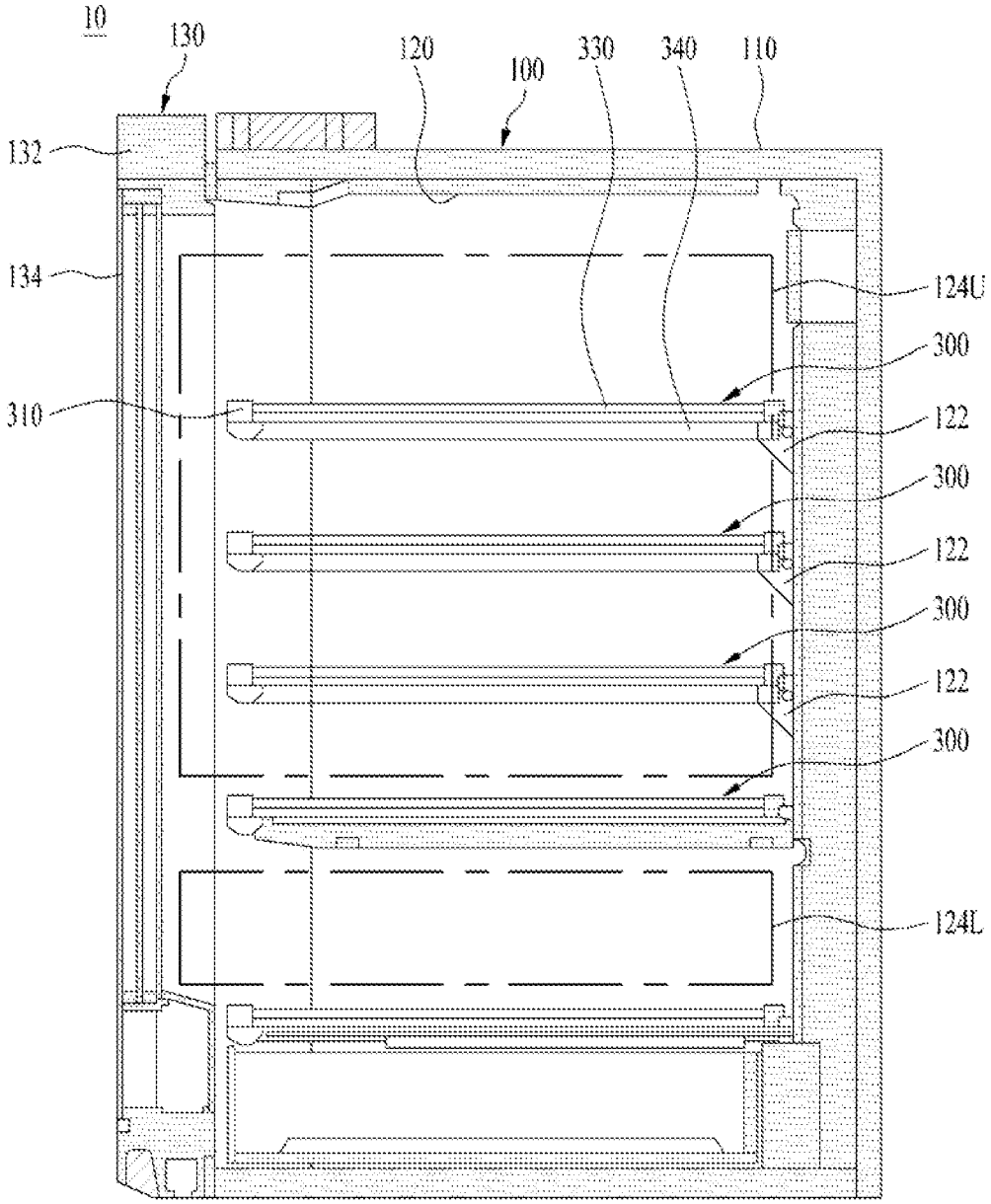
FIG. 3 is a simplified diagram illustrating first storage of a refrigerator according to the present disclosure.

FIG. 3 is a simplified diagram illustrating the first storage 100 of the refrigerator according to the present disclosure.

As shown in FIG. 3, the refrigerator 10 according to the present disclosure is formed in a substantially rectangular parallelepiped shape with an open front face, and has the first storage 100 having the storage space defined therein, and a door 300 for selectively shielding the opened front face of the first storage 100.

First, the first storage 100 includes an outer casing 110 forming an outer shape, an inner casing 120 disposed inside the outer casing 110 in a shape corresponding to the outer casing 110 to define the first storage space 100*a* of the first storage 100, and a heat insulating material (not shown) disposed between the outer casing 110 and the inner casing 120 to prevent heat exchange between a specified space and the outside.

In this connection, the outer casing 110 forms a plurality of faces except for a front face of the first storage 100, that is, top/bottom and side/rear face of the first storage 100. Further, the outer casing 110 may be made of an iron plate material having gloss and a predetermined color such that the outer shape of the refrigerator 10 is easy on the eye.

Further, the inner casing 120 is injection-molded in a shape corresponding to the shape of the outer casing 110, and coupled to the outer casing 110 in a state of being spaced apart from the outer casing 110 by a predetermined distance. The heat insulating material (not shown) foams to form a heat insulating layer and is filled in a space between the inner casing 120 and the outer casing 110.

In one example, a plurality of shelves for partitioning the first storage space 100*a* to expand a loading space depending on a type of the food stored in the first storage space 100*a* may be arranged on an inner face of the inner casing 120 defining the first storage space 100*a*.

In an embodiment of the present disclosure, the wine is stored in the first storage space 100*a*, and the plurality of shelves may be arranged as wine shelves 300 for expanding a loading space of the wine stored in the first storage space 100*a*.

However, the wine shelves 300 in the embodiment of the present disclosure may be used not only for the loading of the wine but also for loading of other foods, and uses of the wine shelves 300 are not limited.

That is, even when the wine shelves 300 of the present disclosure are used for loading the other foods, the wine shelves 300 may be included in a category of the present disclosure when having a structure of the wine shelves 300.

In one example, the plurality of wine shelves 300 are arranged in the first storage space 100*a*. Further, a shelf support 122 for detachably coupling each of the plurality of wine shelves 300 on which the wine is placed to an inner rear face of the inner casing 120 defining the first storage space 100*a* is disposed in the first storage space 100*a*.

In this connection, a plurality of shelf supports 122 may be arranged to be spaced apart from each other at regular spacings in a height direction of the first storage space 100*a* on the inner rear face of the inner casing 120. That is, the shelf supports 122 may be respectively formed to protrude to a predetermined height in a direction facing each other from a wall face of the inner casing 120 rearward of the wine shelves 300, and may be fastened and fixed on the rear face of the inner casing 120 using a separate component.

In one example, the shelf support 122 may have a groove (not shown) defined therein into which a hook 342 formed on a shelf bracket 340 of the wine shelf 300 to be described later is inserted and mounted.

Thus, each wine shelf 300 may be selectively mounted on each shelf support 122 to adjust the spacing between adjacent two of the plurality of wine shelves 300. In this connection, a spacing in a vertical direction between the two adjacent shelf supports 122 is formed to be larger than a diameter of the wine bottle to be stored on the wine shelf 130, and may be selectively adjusted as needed.

In one example, the first storage space 100*a* defined by the inner casing 120 may be divided into a plurality of storage regions 124U and 124L having different temperatures depending on the type of the wine stored therein. In the present disclosure, the storage regions 124U and 124L may include an upper region 124U and a lower region 124L. The numbers of the upper region 124U and the lower region 124L may be increased or decreased to appropriate numbers depending on a capacity and a purpose of use of the storage space.

For example, red wine and the like, which are kept at a relatively high temperature, may be stored in the upper region 124U, and white wine and the like, which are kept at a relatively low temperature, may be stored in the lower region 124L.

As such, dividing of the first storage space 100*a* based on the temperature is because changing the storage temperature depending on the type of the wine is good for ripening of the wine, and a consumer's preference may be increased. Further, because an energy consumption efficiency may also be increased by efficiently maintaining the temperature depending on the storage location of the wine.

Further, the door 130 is pivotably hinge-coupled to the open front face of the first storage 100, so that the door 130 selectively shields the front face of the first storage 100. Such door 130 may include a door frame 132 forming an outer shape of the door 130, and having a penetrated center portion, and a light transmitting window 134 formed in the penetrated portion of the door frame for allowing the wine stored in the storage space of the first storage 100 to be identified.

In one example, a manipulator 136 for controlling operating states of the first storage 100 and the second storage 200 of the refrigerator 10, and a display 138 for displaying the operating states of the first storage 100 and the second storage 200 may be formed on an outer face of the door 130. In this connection, the manipulator 136 and the display 138 may be selectively located on the door frame 132 or the light transmitting window 134.

Hereinafter, the wine shelves of the present disclosure will be described in detail with reference to the accompanying drawings.

Figure 4:
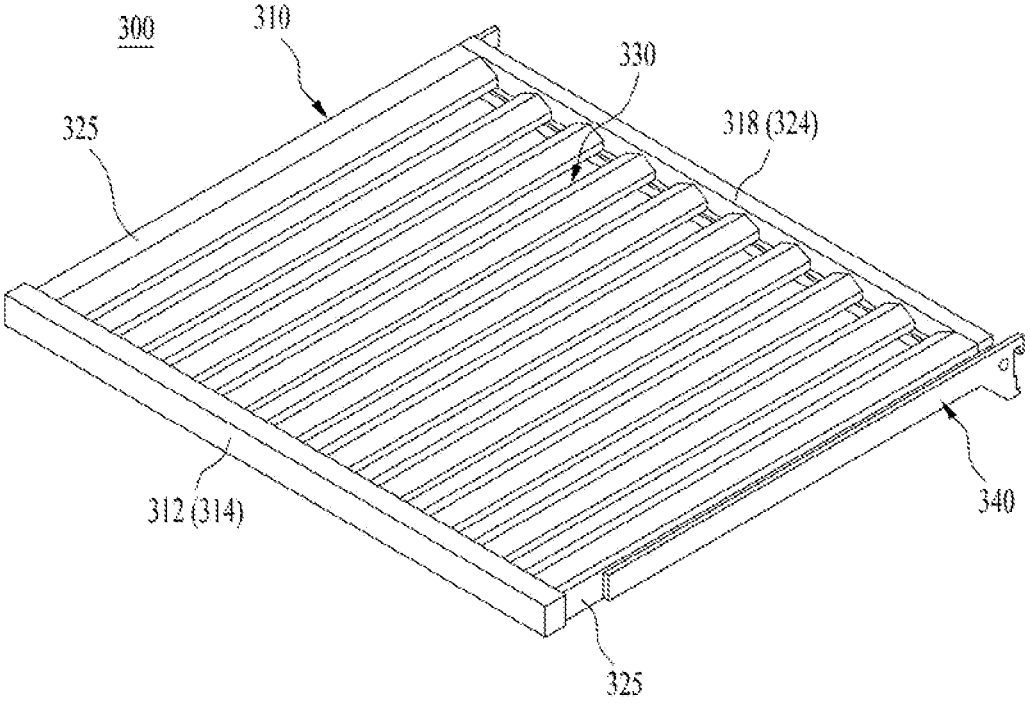
FIG. 4 is a perspective view illustrating a wine shelf of a refrigerator according to the present disclosure.

FIG. 4 is a perspective view illustrating a wine shelf of a refrigerator according to the present disclosure. Further, FIG. 5 is an exploded perspective view illustrating a wine shelf of a refrigerator according to the present disclosure.

Figure 5:
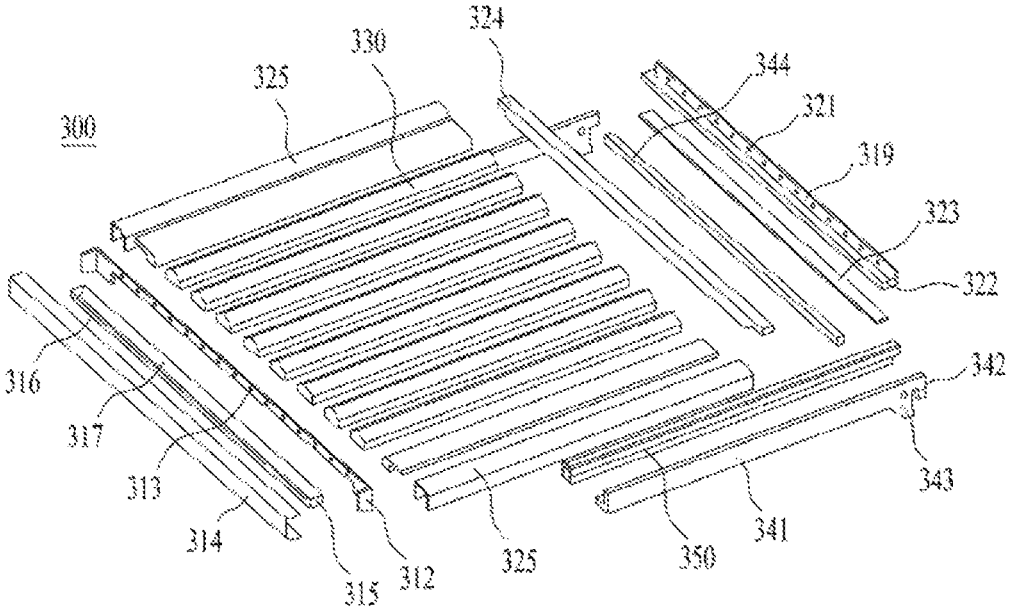
FIG. 5 is an exploded perspective view illustrating a wine shelf of a refrigerator according to the present disclosure.

As shown in FIGS. 4 to 5, the wine shelf 300 of the refrigerator 10 according to the present disclosure may include a lamp mounted and fixed to one of the plurality of shelf supports 122 arranged on the rear face of the inner casing 120, wherein the lamp is able to be forwardly withdrawn from the first storage 100, and at the same time, illuminates wine stored on another wine shelf 300 below.

Such wine shelf 300 may include a frame 310 formed of a rectangular frame having a size and a width corresponding to the first storage space 100*a* of the first storage 100, a plurality of support bars 330 arranged inwardly of the frame and coupled to the frame in a front and rear direction of the frame 310, and having a spacing therebetween smaller than the diameter of the wine bottle, a shelf bracket 340 mounted and fixed on the shelf support 122 of the inner casing 120 and supporting both sides of the frame 310, and an extending rail 350 disposed between the frame 310 and the shelf bracket 340 to support frame 310 movably against the shelf bracket 340.

In this connection, the frame 310 includes a front frame 311 forming a front face of the wine shelf 300 and having a front lamp module 315 that irradiates light in a rearward direction to another wine shelf 300 located below, a rear frame 318 forming a rear face of the wine shelf 300 and having a rear lamp module 322 that irradiates light in a forward direction to another wine shelf 300 located below, and each of a pair of side frames 325 connecting one of both ends of the front frame 311 with one of both ends of the rear frame 318, and at the same time, fixing the extending rail 350. In one example, the front frame 311 and the rear frame 318 may be made of a metal or a synthetic resin material.

In this connection, the front frame 311 includes a front fixing portion 312 extending in a width direction at a front portion of the wine shelf 300, wherein a front end of the support bar 330 to be described later is fixed to the front fixing portion 312, a front decor 314 fastened to the front fixing portion 312 to form a front face of the frame 310, and the front lamp module 315 disposed between the front fixing portion 312 and the front decor 314 to irradiate the light downwardly and rearwardly of the wine shelf 300.

In this connection, the front lamp module 315 includes a rectangular PCB substrate 316 having a plurality of LED lamps, and a front diffusion plate 317 for irradiating light generated from the LED lamps downwardly and rearwardly of the wine shelf 300.

In one example, the rear frame 318 includes a rear fixing portion 319 extending in the width direction at a rear portion of the wine shelf 300, wherein a rear end of the support bar 330 to be described later is fixed to the rear fixing portion 319, and the rear lamp module 322 disposed below the rear fixing portion 319 to irradiate the light downwardly and forwardly of the wine shelf.

In this connection, the rear lamp module 322 includes a rectangular PCB substrate (not shown) having a plurality of LED lamps, and a rear diffusion plate 323 for irradiating light generated from the LED lamps downwardly and forwardly of the wine shelf 300.

In one example, a plurality of through-holes 313 may be defined in the front frame 311 and a plurality of through-holes 321 may be defined in the rear frame 318. Each fastener (e.g., a screw and the like) may pass through each through-hole and be inserted into each of both ends of each of the plurality of support bars 330. In addition, a hook bar 324 may be further inserted and fastened between the rear frame 318 and the support bar 330 to prevent the wine seated on the support bar 330 from sliding rearwardly of the wine shelf 300.

In one example, the support bar 330 is to support the wine bottles that are arranged and stored at regular spacings between the front frame 311 and the rear frame 318 as described above. The support bars 330 may be arranged and fixed at spacings smaller than the diameter of the wine bottle.

Further, downwardly inclined faces 331 (see FIG. 7), which is inclined in a tangential direction of a circumferential face of the seated wine bottle to improve a support state of the wine bottle seated on the support bar 330 may be respectively formed on both sides of an upper face of each support bar 330.

In addition, the support bar 330 and the hook bar 324 described above may be made of the same synthetic resin or metal material as the front frame 311 and the rear frame 318, but preferably made of a wood or synthetic resin having a relatively low hardness than a glass bottle forming the wine bottle in order to protect the loaded wine bottle. In addition, when the support bar 330 and the hook bar 324 are made of the wood, an esthetic sense may be improved in the loading of the wine bottles.

In one example, the side frames 325 are respectively arranged in a symmetrical form on both sides of the wine shelf 300, and extend in a longitudinal direction of the wine shelf 300 to form both side faces of the wine shelf 300, respectively. A lower portion of each of such side frames 325 is opened, and each extending rail 350 is inserted and fixed into the opened lower portion of each of such side frames 325.

In addition, the shelf bracket 340 is for supporting the frame 310 in an extendable manner by being fastened to the shelf support 122 disposed on the inner rear face of the inner casing 120. Two shelf brackets 340 are arranged at both ends of the frame 310 in a symmetrical form and fastened to the both ends of the frame 310 in a symmetrical direction.

In one example, the shelf bracket 340 includes a support 341 having a length shorter than a length of one side face of the frame 310, the hook 342 formed at a rear end of the support 341 and mounted on an upper end of the shelf support 122, and a supporting protrusion 343 located below the hook 342 and supporting a lower end of the shelf support 122.

In this connection, the shelf bracket 340 supports the frame 310 in a form of a cantilever, which allows the support 341 to be supported in a level state while the hook 342 is mounted on the upper end of the shelf support 122 and the supporting protrusion 343 supports the lower end of the shelf support 122.

In one example, the two shelf brackets 340 are arranged to support the frame 310 by the extending rails 350 in a form facing each other at the both ends of the frame 310, respectively. Further, a connection bar 344 for connecting the two shelf brackets 340 with each other may be further disposed to prevent each shelf bracket 340 from twisting. Such connection bar 344 is disposed to respectively connect the support 341 and the supporting protrusion 343 of one shelf bracket 340 with the support 341 and the supporting protrusion 343 of the other shelf bracket 340, which faces one shelf bracket 340. Preferably, the connection bar 344 connects one shelf bracket 340 with the other shelf bracket 340 at a position adjacent to both supporting protrusions 343 of one shelf bracket 340 and the other shelf bracket 340.

Accordingly, an embodiment of an operation of the wine shelf 300 according to an embodiment of the present disclosure will be described in detail. Each element to be mentioned below should be understood with reference to the above description and drawings.

Figure 6:
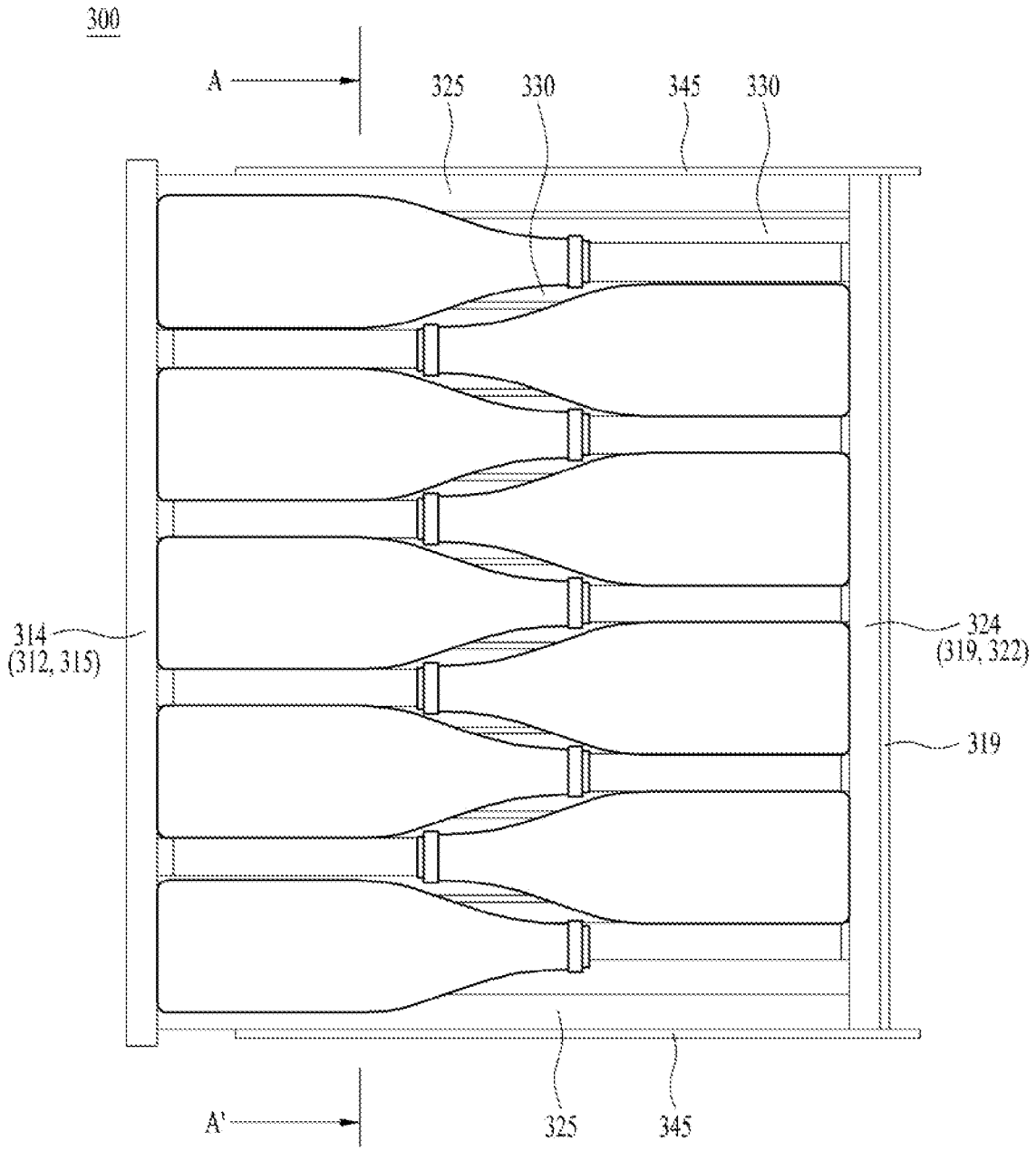
FIG. 6 is a plan view illustrating a wine shelf of a refrigerator according to the present disclosure.
Figure 7:
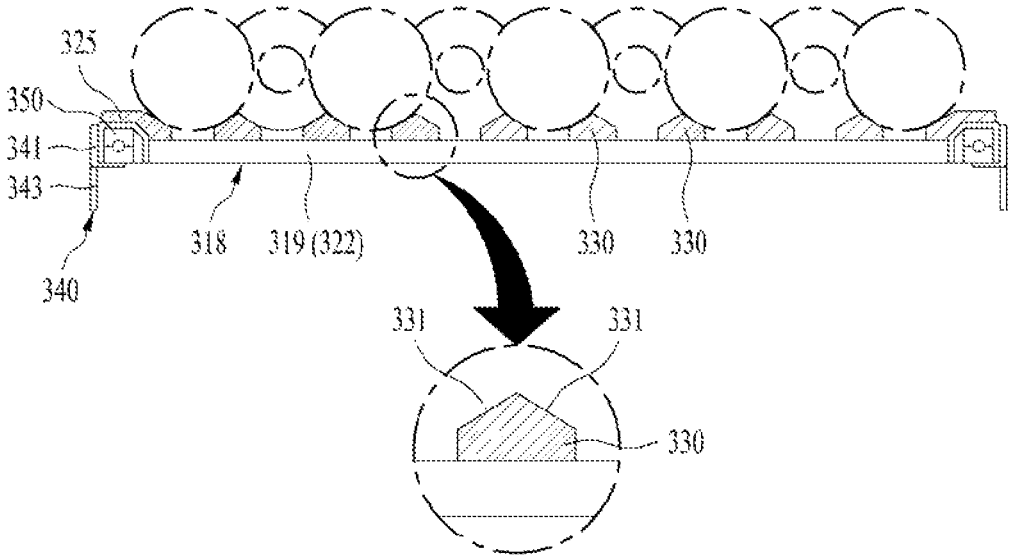
FIG. 7 is a cross-sectional view taken along a line A-A' of FIG. 5.

FIG. 6 is a plan view illustrating a shelf of a refrigerator according to the present disclosure. Further, FIG. 7 is a cross-sectional view taken along a line A-A' of FIG. 5. Further, FIG. 8 is a simplified diagram illustrating use states of shelves of a refrigerator according to the present disclosure.

Figure 8:
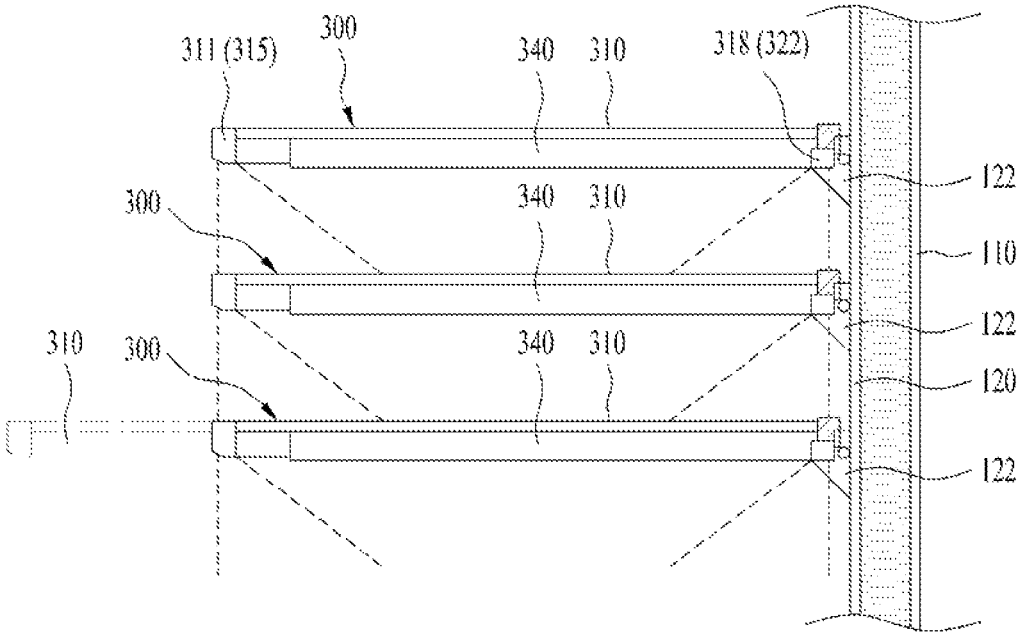
FIG. 8 is a simplified diagram illustrating use states of wine shelves of a refrigerator according to the present disclosure.

As shown in FIGS. 6 to 8, the user may place and store each wine bottle between adjacent two of a plurality of support bars 330 arranged on the wine shelf.

In this connection, in a case of the wine stored on the wine shelf 300, the wine bottles may be stored on a front portion and a rear portion of the wine shelf 300, respectively. The wine bottle is usually divided into a neck and a body, and the neck is relatively smaller in diameter than the body.

Thus, when the wine bottles are stored on the front and rear portions of the wine shelf 300, a neck of a wine bottle stored on the front portion and a neck of a wine bottle stored on the rear portion may be alternated in a direction facing each other in a zigzag form.

In this connection, both sides of an outer circumferential face of the wine bottle stored between the adjacent two of the plurality of support bars 330 are respectively in line contact with the downwardly inclined faces 331 formed on the support bar 330 and supported, so that the wine bottle may be prevented from rotating. Alternatively, the hook bar 324 located at the rear of the support bars 330 may support the neck or the body of the wine bottle to prevent the wine bottle from moving rearwardly of the wine shelf 300.

In one example, the support bar 330 of the wine shelf 300 on which the wine bottle is stored may be made of wood having a hardness lower than the hardness of the wine bottle. In this connection, the wine bottle may be prevented from being damaged or slipping when being stored on the wine shelf 300.

In one example, the front lamp module 315 and the rear lamp module 322 arranged on the wine shelf 300 may be associated with the door 130 of the refrigerator 10 or the manipulator disposed on the door 130.

That is, the front lamp module 315 and/or the rear lamp module 322 may be associated with a separate sensor (not shown) for detecting the opening of the door 130 as the door 130 is opened. Thus, the front lamp module 315 and/or the rear lamp module 322 may be powered only when the door 130 is opened. Alternatively, operations of the front lamp module 315 and/or the rear lamp module 322 may be selectively controlled through the manipulator disposed on the door 130.

Thus, when the user opens the door 130 to store the wine, the front lamp module 315 and/or the rear lamp module 322 are/is turned on as the door 130 is opened. Thus, the wine shelf 300 for storing the wine thereon may be visually identified, so that the wine may be easily stored.

Further, when the user opens the door 130 to withdraw the wine, the front lamp module 315 and/or the rear lamp module 322 are/is turned on as the door 130 is opened. Thus, the wine shelf 300 for storing the wine thereon may be visually identified, so that the user may easily withdraw desired wine.

That is, when the user opens the door 130 to withdraw the wine, as the door 130 is opened, the front lamp module 315 and/or the rear lamp module 322 are/is powered to irradiate light downwardly of each wine shelf 300. Therefore, the user may visually identify the wine stored on each wine shelf 300 and withdraw the desired wine.

In addition, in order to withdraw the wine, the user may extend the frame 310 from the shelf bracket 340 to withdraw the wine loaded on the support bars 330 of the frame 310. That is, as the user extends the frame 310 of the wine shelf 300 on which the wine is stored forwardly of the first storage 100 to withdraw the wine, the frame 310 moves in a sliding manner forwardly of the shelf bracket 340 while being supported by the extending rail 360. Therefore, the user may select and withdraw the wine stored on the wine shelf 300.

In one example, in the wine shelf 300 of the present disclosure, the frame 310 having the support bars 330 on which the wine is loaded, the shelf bracket 340 detachably fixed in the storage space of the inner casing 120, and the extending rail 350 guiding the frame 310 to be extended from the shelf bracket 340 are fastened and integrated with each other.

Thus, when changing a position of the wine shelf 300 in a loading space, the shelf bracket 340 may be separated from the shelf support 122 in the first storage space 100*a* and fastened to a shelf support 122 at another position. Thus, the position of the wine shelf 300 may be changed. Further, the extending rail 350, which extends the frame 310, and the shelf bracket 340, which supports the frame 310, are integrated, so that the wine shelf 300 may easily move.

Further, the front lamp module 315 and/or the rear lamp module 322, which may identify the wine located and stored on a front/rear portion of the below wine shelf 300, are/is disposed on the frame of the wine shelf 300, so that the user may easily identify the type of the wine.

Further, the frame 310 of the wine shelf 300 may be extended forwardly of the first storage space 100*a* by the extending rail 350 from the shelf bracket 340 mounted on the shelf support 122 of the inner casing 120, so that the wine loaded on the frame 310 may be easily withdrawn.

As described above, although the preferred embodiments of the present disclosure have been described in detail, the present disclosure is not limited thereto, but may be variously modified and altered by those skilled in the art to which the present disclosure pertains without departing from the spirit and scope of the present disclosure claimed in the following claims. Thus, modifications of the aforementioned embodiments of the present disclosure will not be departed from the scope of the present disclosure.

The invention claimed is:

1. A refrigerator comprising:

a storage defining a storage space therein;

a door for opening and closing the storage space; and a plurality of shelves disposed in the storage space, wherein at least one of the plurality of shelves includes:

a frame having a plurality of support bars made of wood and for loading a plurality of wine bottles thereon, wherein each said support bar includes downwardly inclined faces configured to contact a circumferential surface of a wine bottle when loaded on the shelf, the downwardly inclined faces extending in a longitudinal direction on both sides of each said support bar;

two shelf brackets detachably mounted in the storage space; and an extending rail disposed between the frame and each said shelf bracket for supporting the frame and for moving against the shelf brackets to extend the frame forwardly from the storage, wherein the frame includes:

a front frame defining a front face of the frame, wherein a front face of each said support bar is fixed to the front frame;

a front lamp module provided at a lower portion of the front frame to irradiate light below the frame in a rearward direction;

a rear frame defining a rear face of the frame, wherein a rear face of each said support bar is fixed to the rear frame;

a rear lamp module provided at a lower portion of the rear frame to irradiate light below the frame in a forward direction; and a side frame at each side of the frame defining each of both side faces of the frame, wherein each said side frame is movably fastened to one said shelf bracket by one said extending rail.

2. The refrigerator of claim 1, wherein the front lamp module is associated with the opening and closing of the door, and is powered when the door is opened.

3. The refrigerator of claim 1, wherein the rear lamp module is associated with the opening and closing of the door, and is powered when the door is opened.

4. The refrigerator of claim 1, wherein the frame further includes a hook bar disposed rearwardly of one said support bar and rearwardly of the shelf.

5. The refrigerator of claim 1, wherein the frame, the extending rails, and the shelf brackets are detachable from a rear face of the storage space in a state of being fastened with each other.

6. The refrigerator of claim 1, further comprising another storage having another storage space defined therein disposed below the storage, wherein the another storage is operated independently of the storage.

7. The refrigerator of claim 6, wherein the another storage includes at least one drawer extendable from the another storage space.

8. The refrigerator of claim 6, wherein the door further includes:

a manipulator for controlling the storage and the another storage; and a display for displaying operating states of the storage and the another storage.

9. The refrigerator of claim 1, wherein the door includes a door frame forming an outer shape of the door and having a hollow center portion, and a window disposed in the hollow center portion of the door frame.

10. The refrigerator of claim 9, wherein the door further includes a manipulator disposed on the door frame or the window.

11. The refrigerator of claim 1, wherein the door further includes a manipulator and the front lamp module is powered when the manipulator is manipulated.

12. The refrigerator of claim 1, wherein the door includes a manipulator and the rear lamp module is powered when the manipulator is manipulated.

* * * * *